US006269874B1

(12) United States Patent
Rawson et al.

(10) Patent No.: US 6,269,874 B1
(45) Date of Patent: Aug. 7, 2001

(54) ELECTRO-HYDRAULIC SURFACE CONTROLLED SUBSURFACE SAFETY VALVE ACTUATOR

(75) Inventors: Michael S. Rawson; Charles M. Tompkins, both of Tulsa; Doug Trott, Coweta, all of OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/302,102

(22) Filed: Apr. 29, 1999

Related U.S. Application Data

(60) Provisional application No. 60/084,233, filed on May 5, 1998.

(51) Int. Cl.[7] ..... E21B 34/06; E21B 44/00

(52) U.S. Cl. ..... 166/53; 166/66.4; 166/66.6; 166/332.6

(58) Field of Search ..... 166/53, 66.4, 66.6, 166/66.7, 319, 321, 332.6, 332.8

(56) References Cited

U.S. PATENT DOCUMENTS

| | | | | |
|---|---|---|---|---|
| 4,215,746 | * | 8/1980 | Hallden et al. | 166/53 |
| 5,226,348 | * | 7/1993 | Dezelan et al. | 91/436 |
| 5,358,035 | | 10/1994 | Grudzinski | 166/53 |
| 5,832,996 | * | 11/1998 | Carmody et al. | 166/66.7 |

FOREIGN PATENT DOCUMENTS

| | | |
|---|---|---|
| 2 267 922 | 12/1993 | (GB) . |
| 2 310 228 | 8/1997 | (GB) . |

* cited by examiner

*Primary Examiner*—William Neuder
(74) *Attorney, Agent, or Firm*—Cantor Colburn LLP

(57) ABSTRACT

An electro-hydraulic surface controlled subsurface safety valve is controllable entirely electrically. The actuator operates on an electrically actuated pressure pump and a supply of hydraulic fluid reservoired in the tool proximate to the safety valve. A dump valve is normally open so that if power fails, pressure is released and the safety valve closes.

21 Claims, 19 Drawing Sheets

ELECTRO-HYDRAULIC SURFACE CONTROLLED SUBSURFACE SAFETY VALVE ACTUATOR

CROSS-REFERENCE TO RELATED APPLICATIONS

This application claims the benefit of U.S. Provisional Application Serial No. 60/084,233 filed May 5, 1998.

BACKGROUND OF THE INVENTION

1. Field of Invention

The invention relates to surface controlled subsurface safety valves. More particularly, the invention relates to electro-hydraulic actuation systems for such valves.

2. Prior Art

Surface controlled subsurface safety valves have been used for many years to prevent such occurrences as "blow-outs" and other dangerous well conditions. Safety valves are designed so that if they fail, they fail in a safe position so that upon a break in the hydraulic fluid system, conventionally supplied at the surface and extended in a small diameter high pressure tubing line downhole, the power spring in the safety valve closes the flapper of the safety valve. The power spring must be able to lift the hydraulic column to the surface. This requires very strong springs and consequently, high opening pressures for valves set very deeply within the earth□s crust.

More recently, electromechanical actuators have been conceived employing electrically actuated mechanical means to open the flapper. The electromechanical systems are extremely effective for installations in which they are specified but different wells have different requirements and the art is still in need of other types of actuating systems.

SUMMARY OF THE INVENTION

The prior art need as noted above is alleviated by the electro-hydraulic surface controlled subsurface safety valve operating system of the invention.

The electro-hydraulic system employs in its broadest concept, a pump having a fluid supply attached thereto, the pump being connected directly to the safety valve. The pump is operated by a downhole electronics package and/or surface electronics package which controls the pump and additionally powers an electrically controlled dump valve connected to the hydraulic discharge fluid line connected between the pump and the conventional subsurface safety valve. When the solenoid of the dump valve is powered, the dump valve is closed and pressure generated by the pump is transmitted to the safety valve to operate the same. Upon interruption of power whether by design or by happenstance, the solenoid on the dump valve opens and the safety valve shuts, the power spring thereof being powerful enough to move the small amount of hydraulic fluid necessary back into the fluid supply chamber or reservoir through the dump valve. Thus the valve is quickly (about 5 seconds) and easily closed by interrupting power at the surface and additionally closes in the event power is lost for any other reason.

An advantage of the system is that it preferentially maintains the hydraulic fluid reservoir downhole and in proximity to the other components of the system. This avoids the long fluid column to the surface that is part of most systems in the prior art. This also eliminates the necessity of a strong power spring when the valve is set deep as the hydraulic column does not extend to the surface. The safety valve power spring needs to lift the weight of moving parts and overcome friction, both known from prior art.

Two pump arrangements are contemplated for the system, although other pumping arrangements could be substituted. The system preferably employs a pressure compensated annular reservoir within which the pump, a manifold and dump valve are disposed. Advantages are gained by placing these components in the hydraulic fluid of the reservoir. More specifically, the components are protected from well-bore fluids by the enclosed hydraulic fluid and may thus be constructed from less expensive materials. The pump remains well lubricated and cooled.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENTS

Each of the preferred embodiments of the invention employ the reservoir, electronics package and the solenoid dump valve. These elements will be essentially unchanged in both of the embodiments. Additionally, each embodiment includes a means to move the hydraulic fluid under pressure to the safety valve inlet. The two preferred embodiments of this invention each employ one of a motor driven pump and a solenoid plunger pump.

Referring to FIGS. 1–6, a first embodiment of the invention is illustrated. This embodiment employs the motor-driven hydraulic pump arrangement as the fluid moving component.

Figure 1:
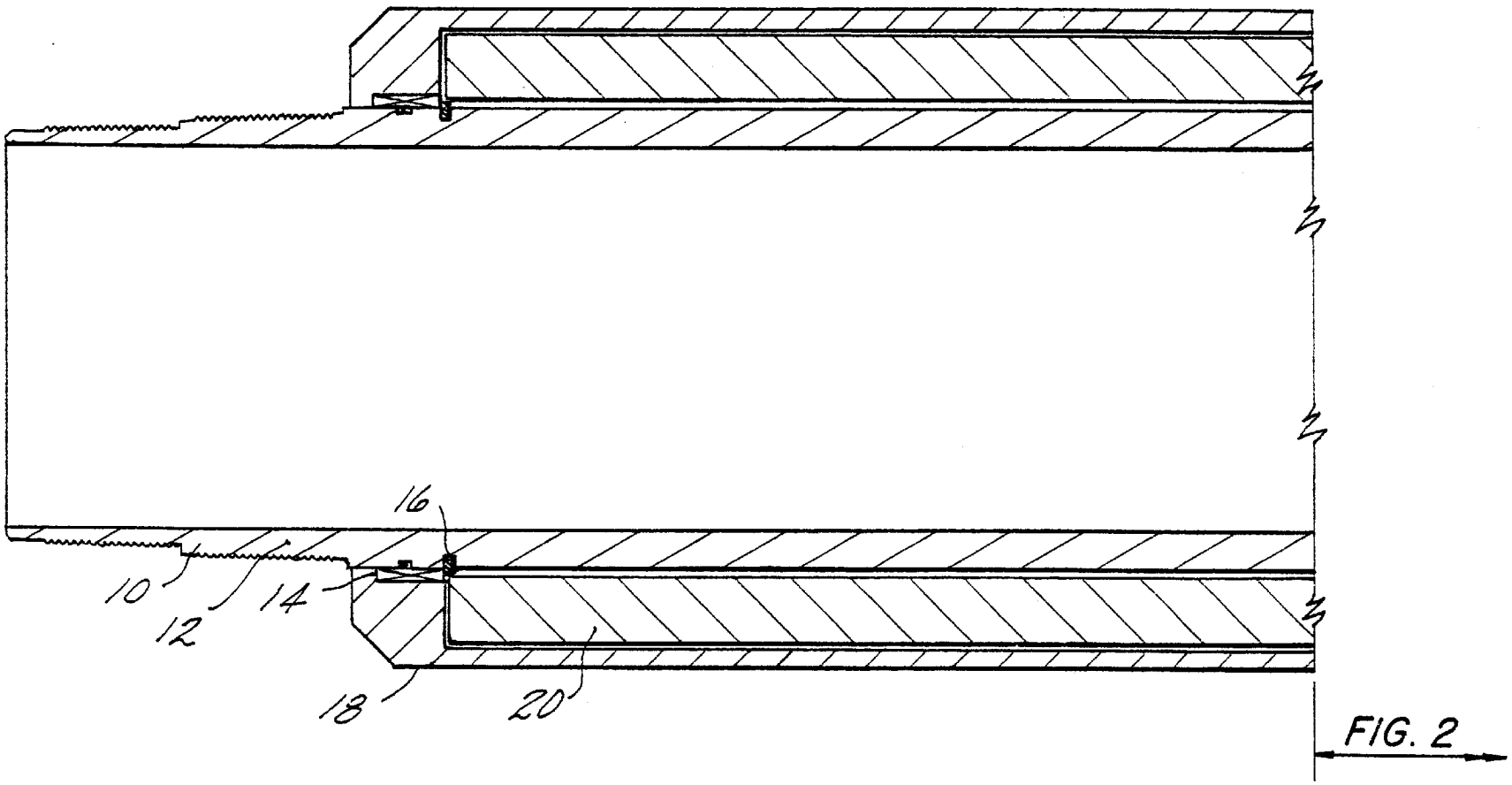
FIGS. 1–6 are an elongated cross-section view of the motor driven pump embodiment of the invention.
Figure 2:
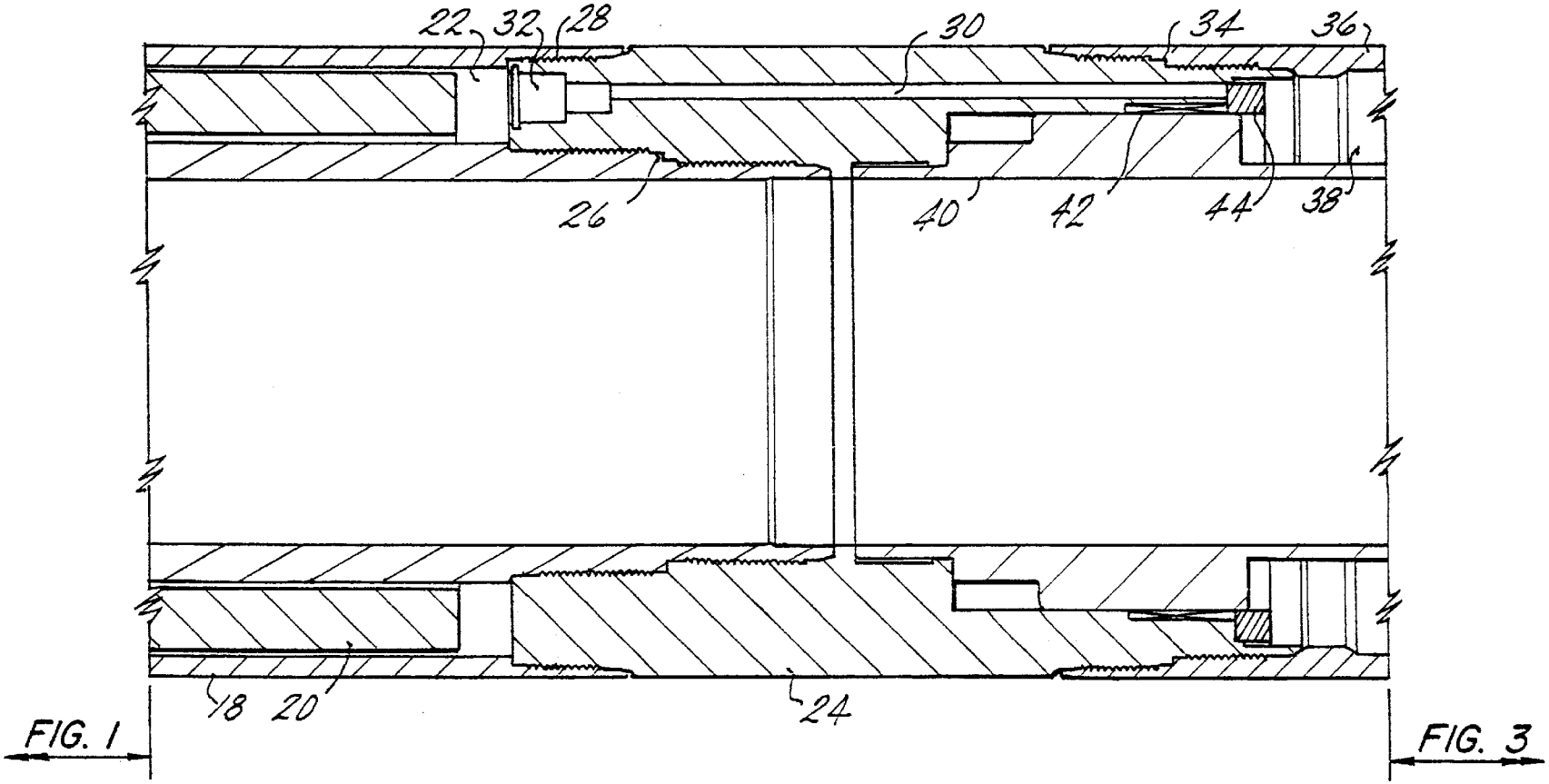
Figure 6:
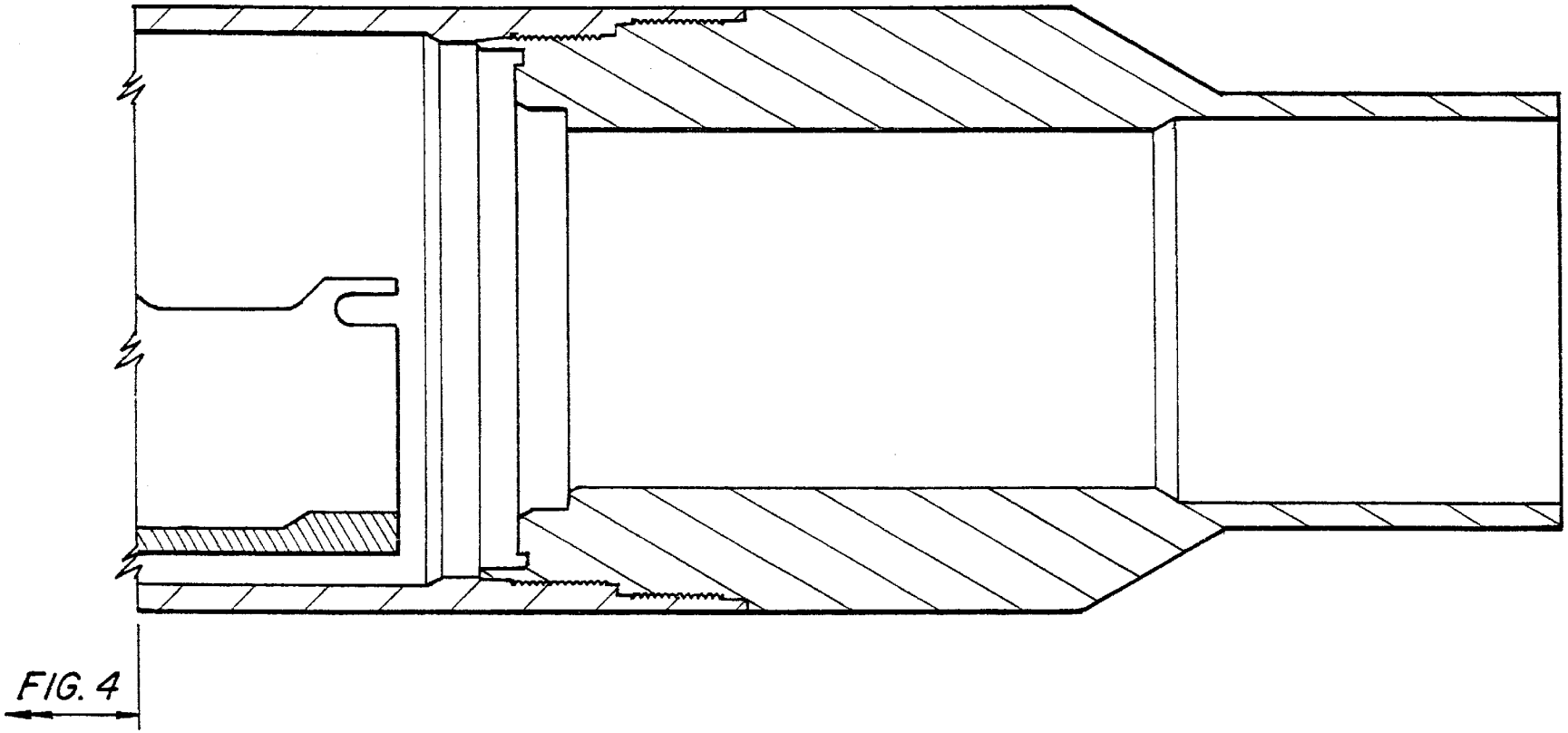
Figure 7:
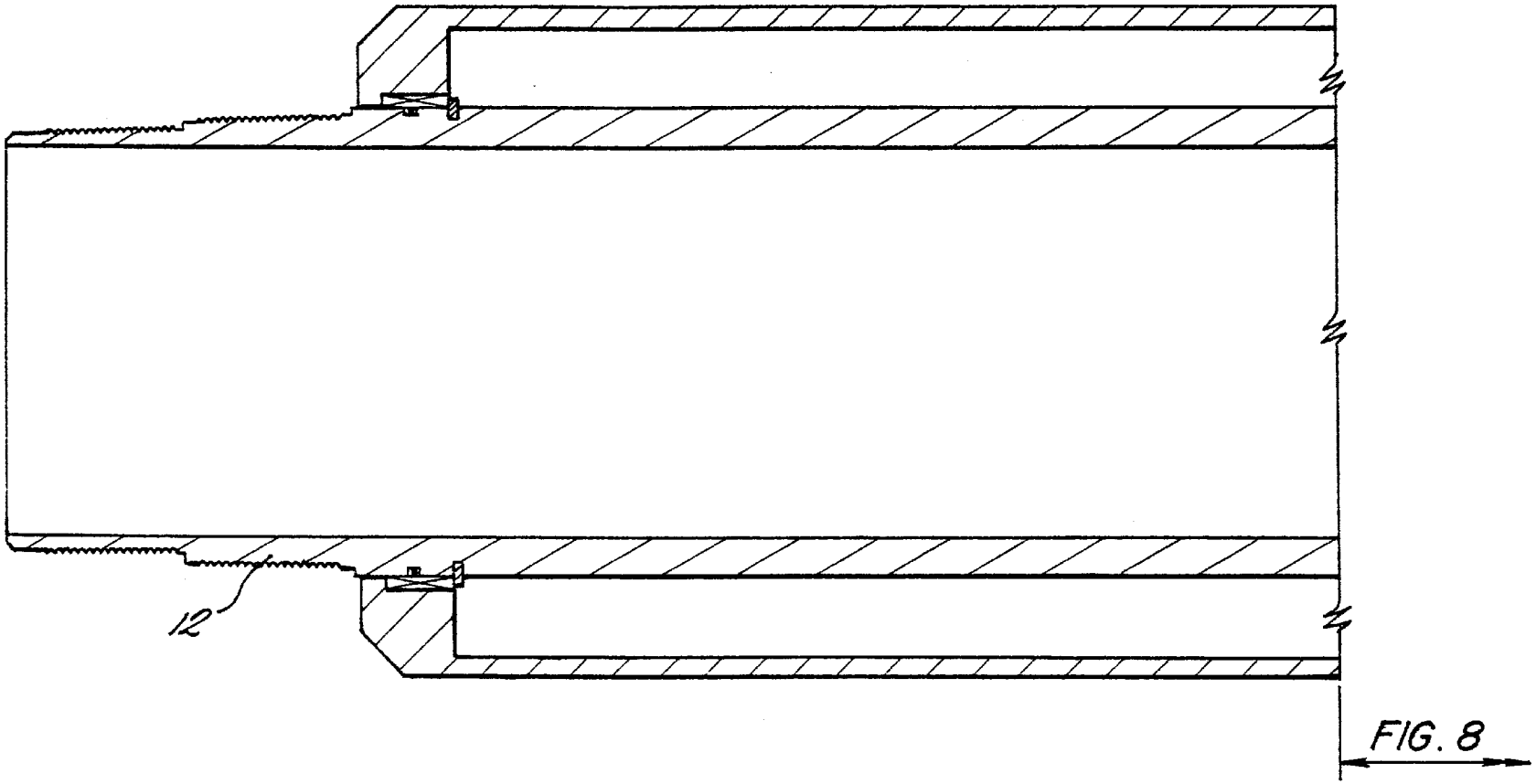
FIGS. 7–12 are an elongated cross-section view of the solenoid plunger pump embodiment of the invention.
Figure 8:
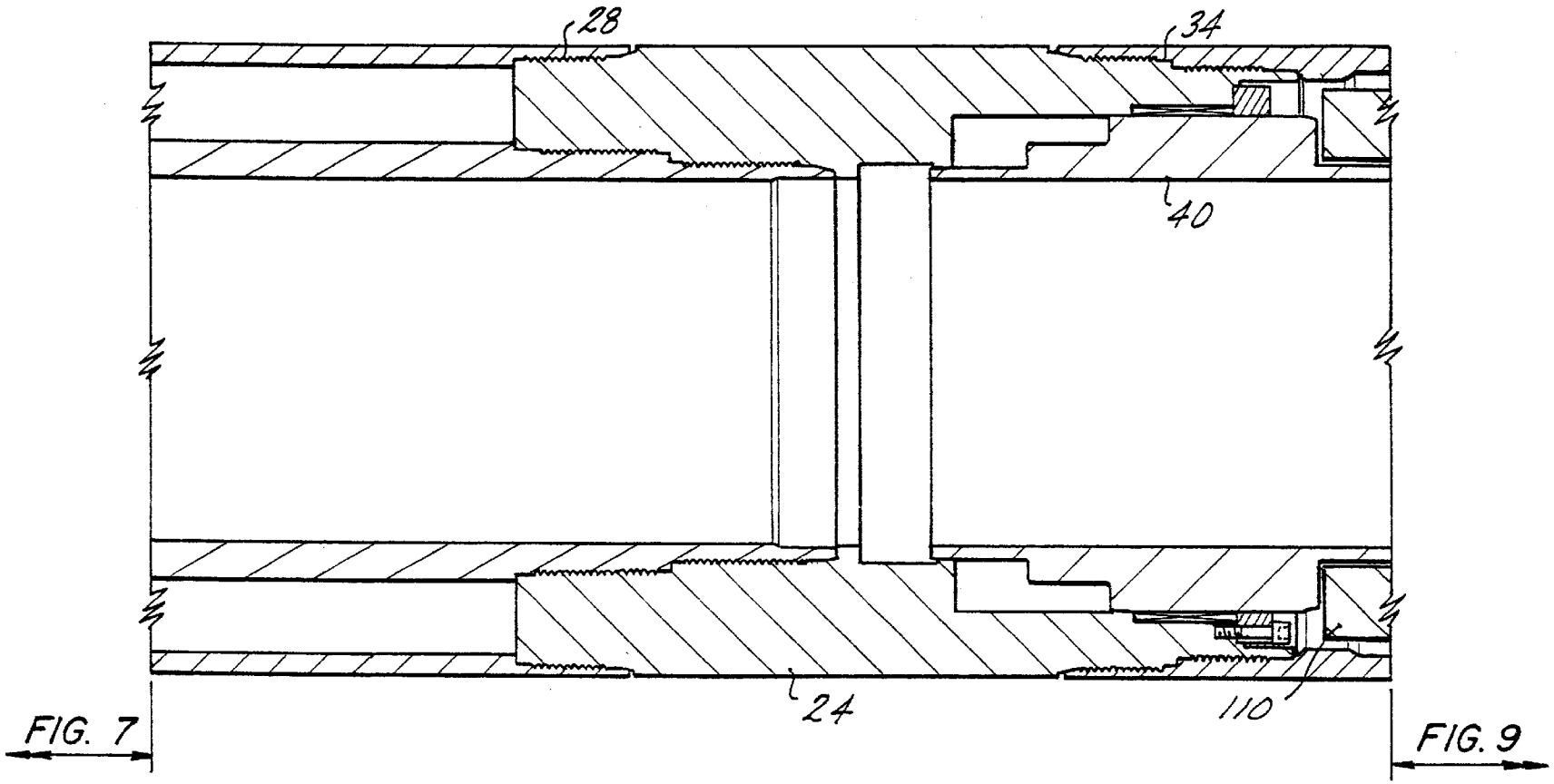

Referring first to FIG. 1 and moving sequentially through FIG. 6, the invention comprises electronics housing 12 having preferably an uphole premium thread connection for connecting the system of the invention to a string of pipe (not shown). Electronics housing 12 supports electronics package 20 within an annular space 22 preferably filled with nitrogen and which is defined radially inwardly by housing 12 and radially outwardly by electronics cover 18. The gas contained in the space 22 is maintained therein by a seal 14 and snap ring 16 at the uphole end of the electronics cover 18 while the downhole end of the cover 18 is sealed by premium threaded connections which connect the electronics sub to the intermediate sub 24. As is readily appreciated from a review of the drawing FIG. 2, electronics housing 12 is connected to intermediate sub 24 by preferably a premium thread 26 at the radially inward extent thereof, while the cover 18 is connected to intermediate sub 24 by a premium threaded connection 28.

Intermediate sub 24 is employed for manufacturability reasons and supports a through bore 30 having a connector part 32 at the uphole end thereof which preferably is constructed to receive a Kemlon connector (not shown). Bore 30 provides passage for a current carrying conduit (not shown) to power the pump and solenoid dump valve discussed hereunder.

Attached at the downhole end of intermediate sub 24 by preferably a premium threaded connection 34 is pump housing 36. Pump housing 36 extends downhole to connect with a cylinder sub 96 of a conventional surface controlled subsurface safety valve (SCSSV) by preferably a premium threaded connection 98. Pump housing 36 contains in an annular space 38, between it and compensator piston 40, which space 38 is sealed by a large dynamic seal 42, retained by retainer 44 and by small dynamic seal 52, retained by manifold 54. Also contained in the annular space 38 are motor 46 connected to hydraulic pump 48 which then is connected to discharge connector 50 and mounted to manifold 54. Annular space 38 is, in a preferred embodiment, also the reservoir for the hydraulic fluid supply employed to open the conventional components of the SCSSV. The space 38 contains the components noted as well as the manifold 54 to advantageously bathe the components in the hydraulic fluid in a preferred embodiment.

Significant benefits are realized by placing all of the components noted directly in the reservoir space 38. These benefits include reduction of length of the tool (more than one function contained in a single space), longevity increase of the bathed components (no deleterious effects from well bore fluids) and the ability to use more economical materials such as stainless steel instead of expensive materials such as inconel which would be necessary if the manifold were in contact with wellbore fluids. Space 38 is pressure compensated to wellbore pressure by compensating piston 40 which employs a large end and a small end corresponding to the large and small seals identified above to render the piston dynamic. Preferably seal 42 is a spring-loaded Teflon seal, commercially available from Greene, Tweed & Co. and seal 52 is a spring-loaded Teflon seal, commercially available from Greene, Tweed and Co. A conventional elastomeric material may be substituted for dynamic sealing.

Motor 46 is preferably a DC brushless type motor which is available commercially from many sources. Hydraulic pump 48 is a radial piston type pump and is also commercially available from many sources.

Figure 3:
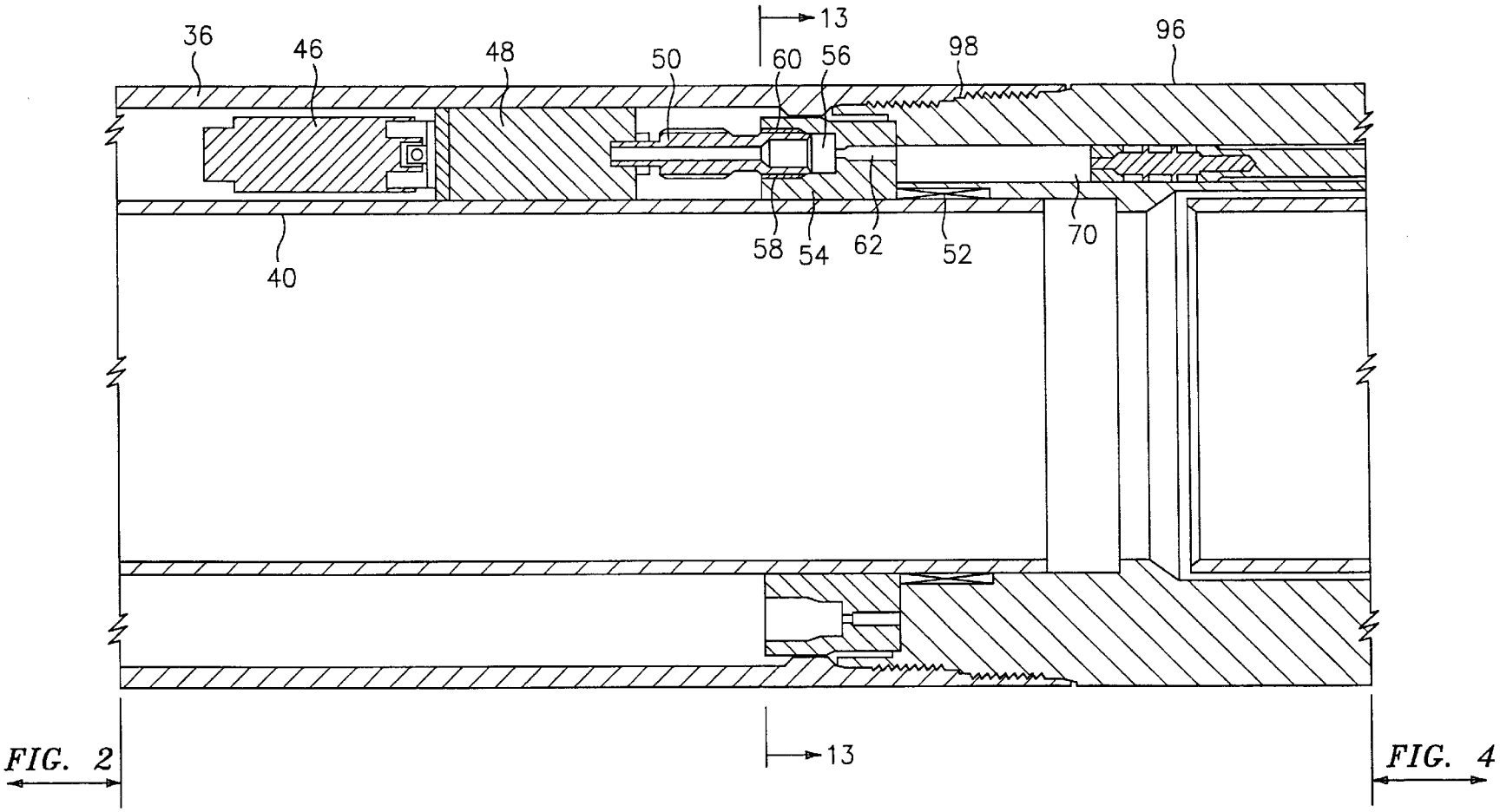
Figure 4:
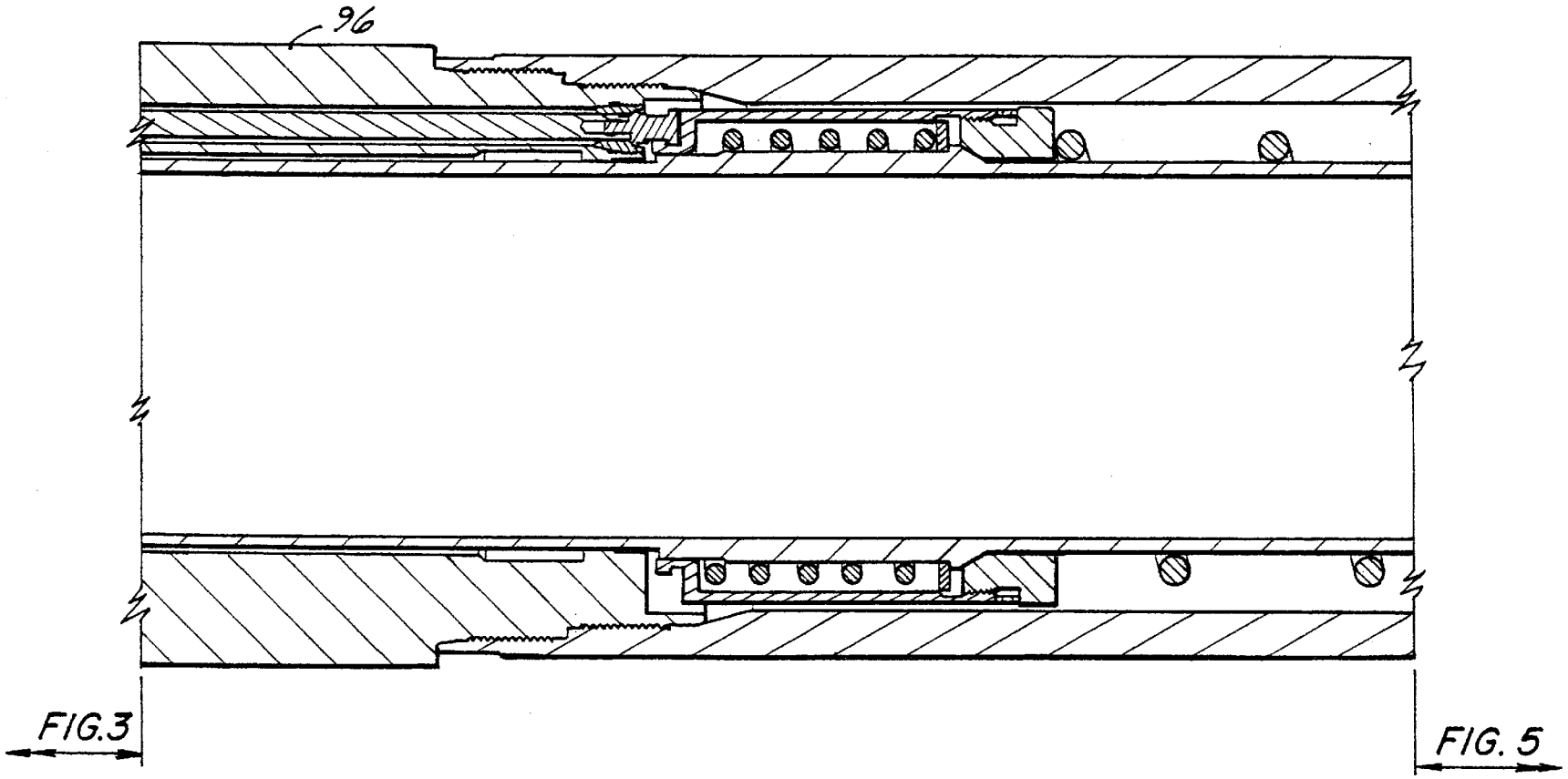
Figure 5:
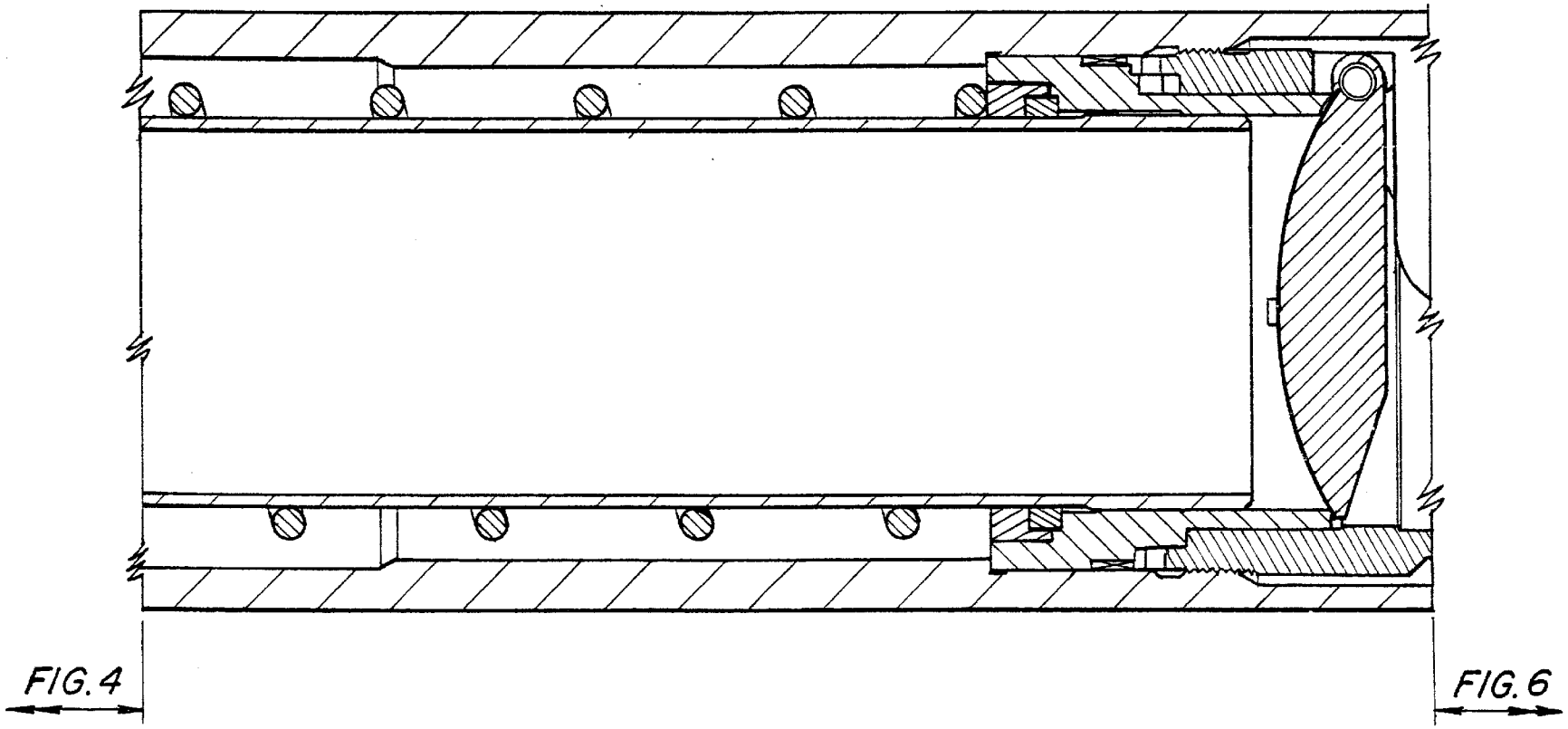
Figure 13:
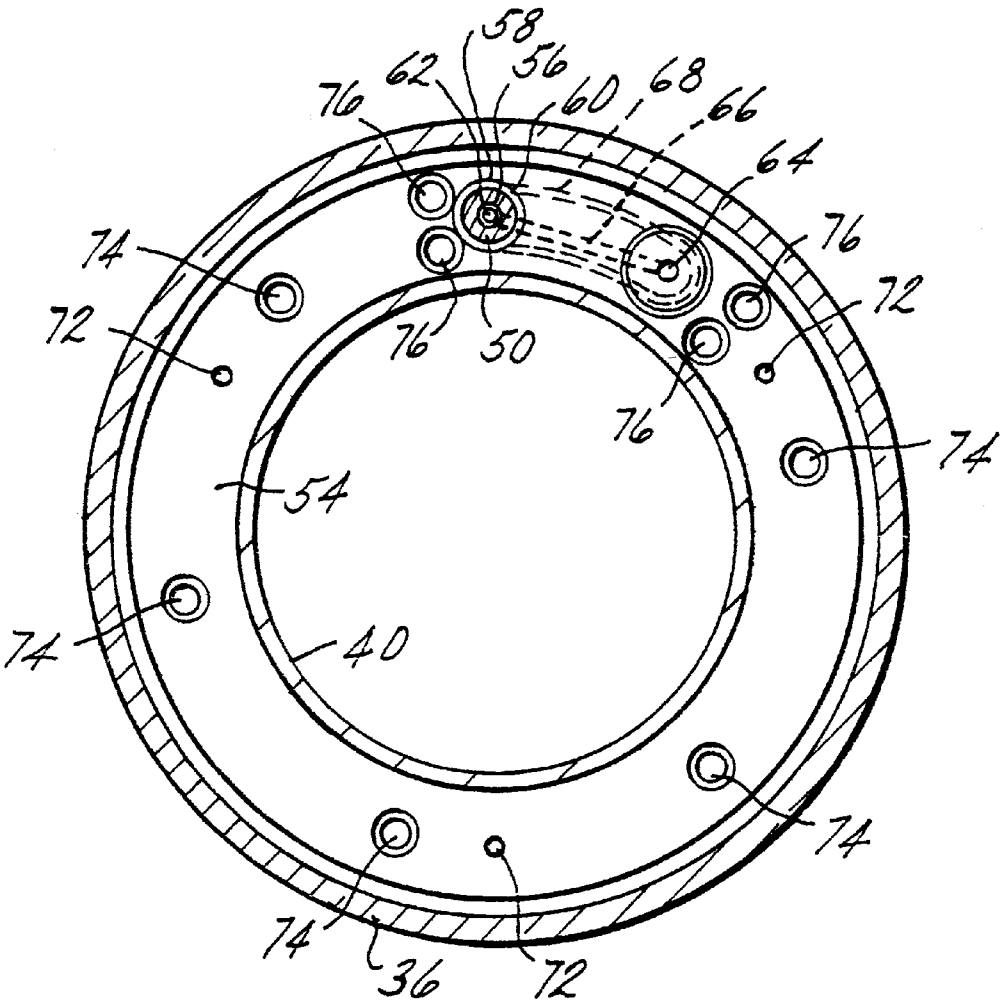
FIG. 13 is a section view taken along section line 13—13 in FIG. 9 illustrating the manifold of the invention.

Referring to FIG. 3, pump 48 is preferably threadedly connected to discharge connector 50 so that pressurized discharge fluid from pump 48 is transferable through manifold 54 to the honed seal bore 70 of the conventional SCSSV. In the cross-section views of FIG. 3 and FIG. 13, it is possible to view recess 56 having metal seal bore 58. Recess 56 connects to fluid port 62 for communication through manifold 54 to fluid hone bore 70. Referring to FIG. 13 directly, other aspects of manifold 54 are illustrated.

In FIG. 13 the manifold 54 is illustrated from the uphole end. Recess 56 is visible as is port 62 both of which are at the 12 o'clock position on the drawing.

Figure 15:
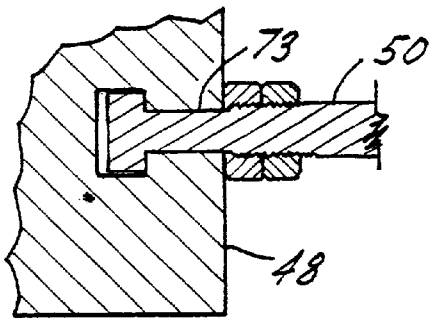
FIG. 15 is a portion of the sleeve of the invention illustrating the T-slot of the invention.
Figure 14:
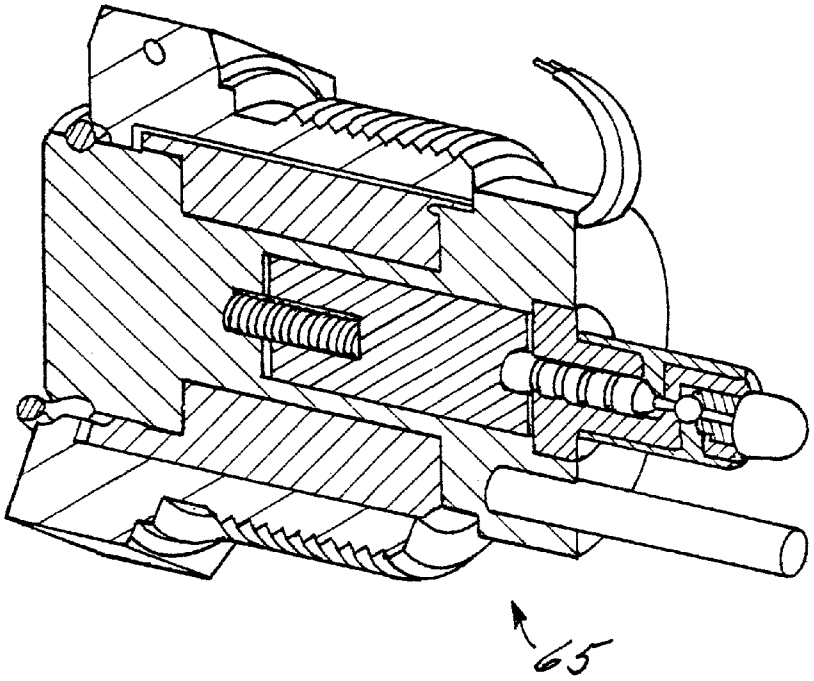
FIG. 14 is a perspective broken open view of a solenoid dump valve.

Important to the invention is solenoid dump valve port 64 which accepts in a sealing relationship, a solenoid actuated normally open dump valve 65 which is commercially available from the Lee Company. A representative illustration of a dump valve as employed in the invention is depicted in FIG. 14. Cross channel 66 is a fluid connection between port 62 and port 64 and allows the safety valve to close if the dump valve opens due to an interruption of power. Operation of this feature will be discussed more fully hereinafter. The manifold is bolted to the sleeve using preferably three points about 120° apart. At these points 72, are holes to accept bolts 73 secured to the sleeve preferably by "T" receptacles therein. More specifically, and referring to FIG. 15, the sleeve is machined radially from the outside diameter thereof to form "T" shaped slots of a dimension sufficient too receive a bolt head and part of its shank and secure the bolts against axial movement. The remainder of the shanks of each connection point are threaded into the manifold 54 at the indicated holes 72. A pair of nuts on each shank are preferably employed to lock the spacing of the manifold from the sleeve.

Referring again to FIG. 13, nine more holes are apparent, Five of these are indicted by numeral 74 and are preferably equidistantly spaced on a six-hole pattern. The position of the sixth hole would be located between the pump discharge port recess 56 and the solenoid dump valve port 64. In lieu of the sixth hole, four holes 76 are provided around the port area. Each of the nine holes are preferably counter sunk as illustrated. Each of the nine holes are intended to receive bolts to secure the manifold to the conventional SCSSV. The four bolts 74 ensure a pressure tight connection in the area defined by the o-ring groove 68. It should be noted that in reservoir 38 a sleeve 39 is preferably installed to take up space so that the volume of fluid in the reservoir can be reduced. The sleeve is preferably aluminum. The reduction is not necessary but is preferred to reduce cost associated with increased piston sleeve 48 travel from hydraulic fluid thermal expansion. The fluid displacement provided by the large annular piston on the piston sleeve 40 provides for the thermal expansion of the hydraulic safety valve and balances the reservoir pressure to the tubing pressure thus requiring that the pump discharge needs only be the differential necessary to compress the power spring, the pump does not have to overcome the tubing side pressure. The back pressure spring provides a positive fluid reservoir pressure required to move the piston sleeve 38 in the dynamic mode while the safety valve is opening in the case of low (atmospheric) tubing pressure. The load on the back pressure spring is dependent on the static and dynamic frictional characteristics of the large and small dynamic seals 42, 52 and the area of the annular piston created between the two. In the preferred embodiment the spring is approximately 280 pounds load for about 25 psi in the reservoir. This positive pressure will also keep wellbore fluids and gases from migrating into the reservoir since the differential pressure is higher in the reservoir.

In operation, electronics package 20 delivers a potential to normally open solenoid dump valve 80 to close the same. Dump valve 80 is preferably a solenoid operating pilot valve, commercially available from Lee Company. With dump valve 80 closed, cross channel 66 is closed and will not bleed off pressure from the fluid hone bore 70 of the conventional SCSSV. Thus, pressure generated by pump 48 is transmitted to the SCSSV to open the same. Upon any interruption in power to the dump valve 80, it returns to its normally open position and dumps the fluid pressure back to the reservoir and the SCSSV closes. Assuming that power remains at dump valve 80, the valve remains closed indefinitely. Upon a signal from the surface, electronics package 20 directs motor 46 to turn pump 48 and generate increasing pressure within inlet 70. As pressure increases, the conventional safety valve will open. When a particular degree of openness (usually fully open) of the safety valve is achieved as measured by a pressure sensor in the inlet, a proximity sensor on the flapper valve, a counter on the motor, etc., the motor is directed to stop moving and to a discharge check valve in the manifold at 62 will hold pressure in the system. The SCSSV is closeable by cutting power to dump valve 80 causing it to open and dump the fluid pressure in bore 70. It should be noted that a significant benefit of the present invention is that the SCSSV will close at any state of opening, immediately upon the dump valve opening. A full stroke is not necessary (i.e. some prior art requires that valve be completely open before closing is possible).

Figure 9:
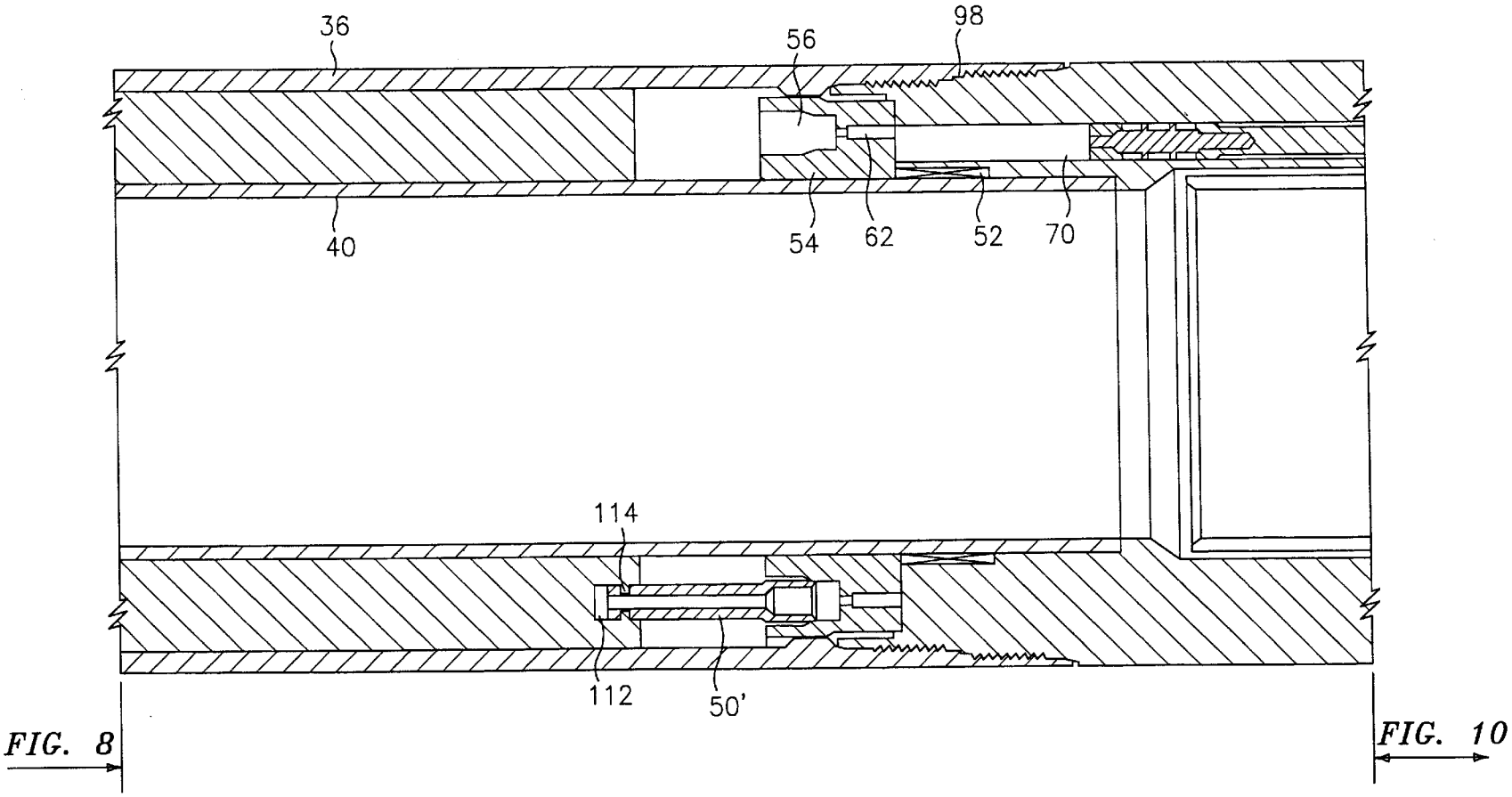
Figure 10:
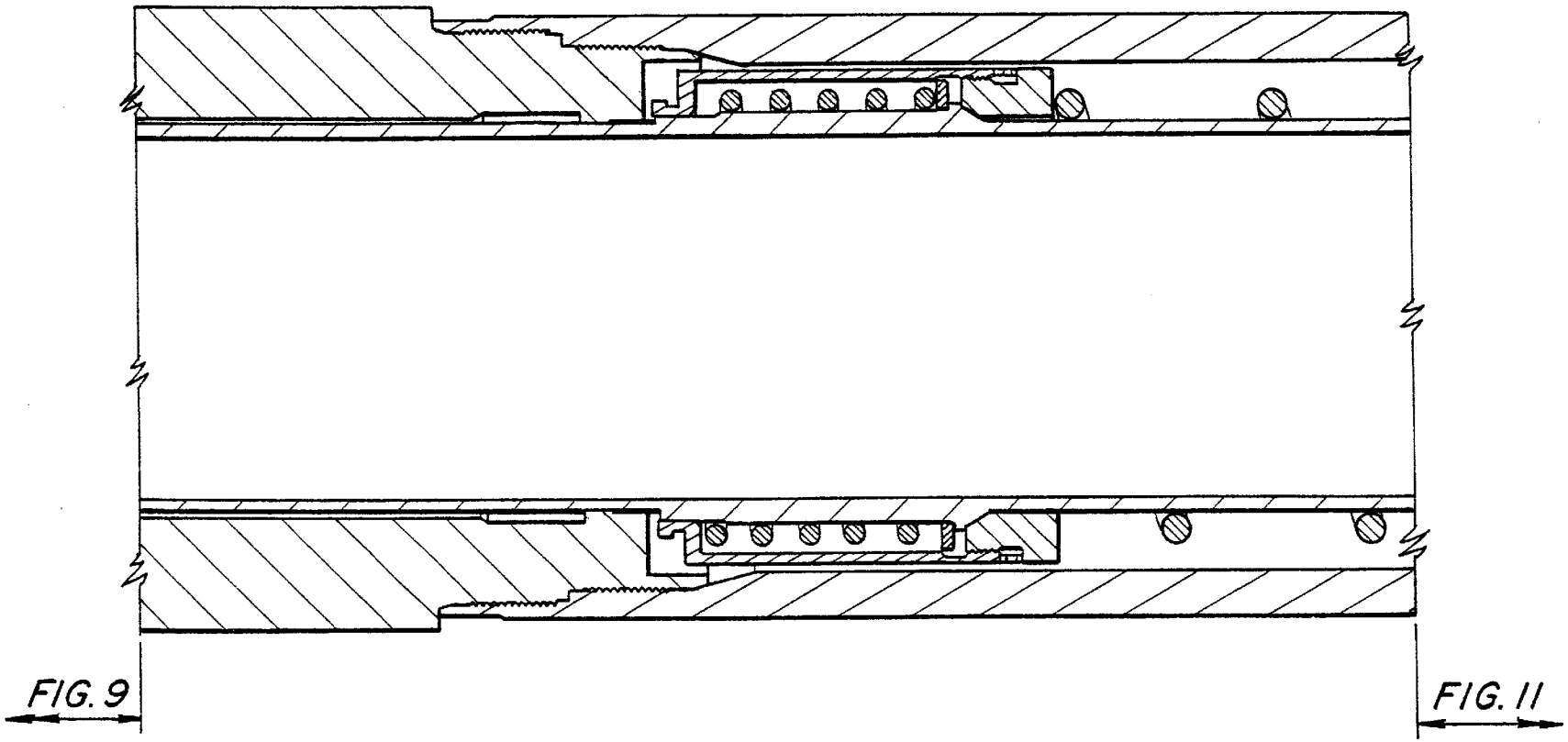
Figure 11:
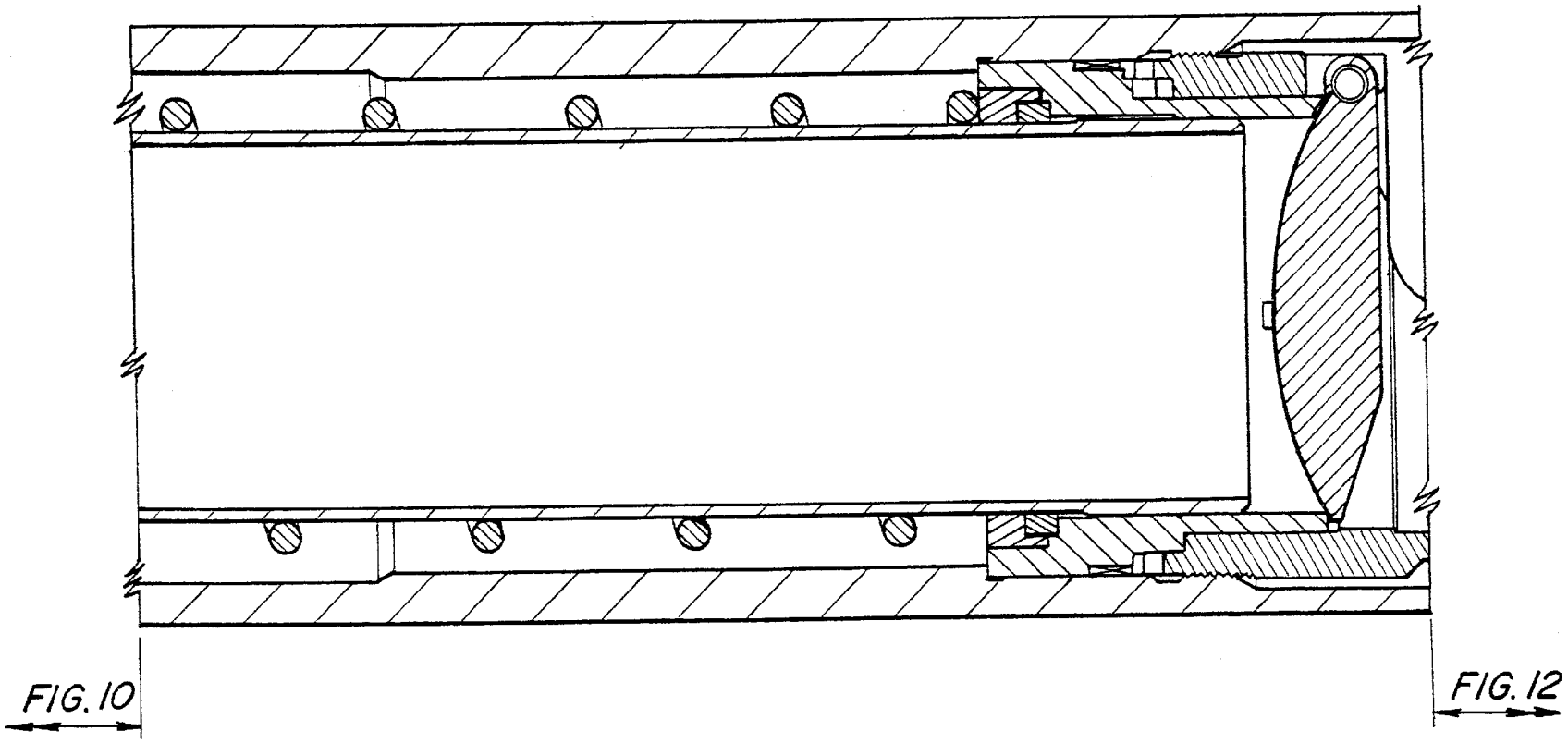
Figure 12:
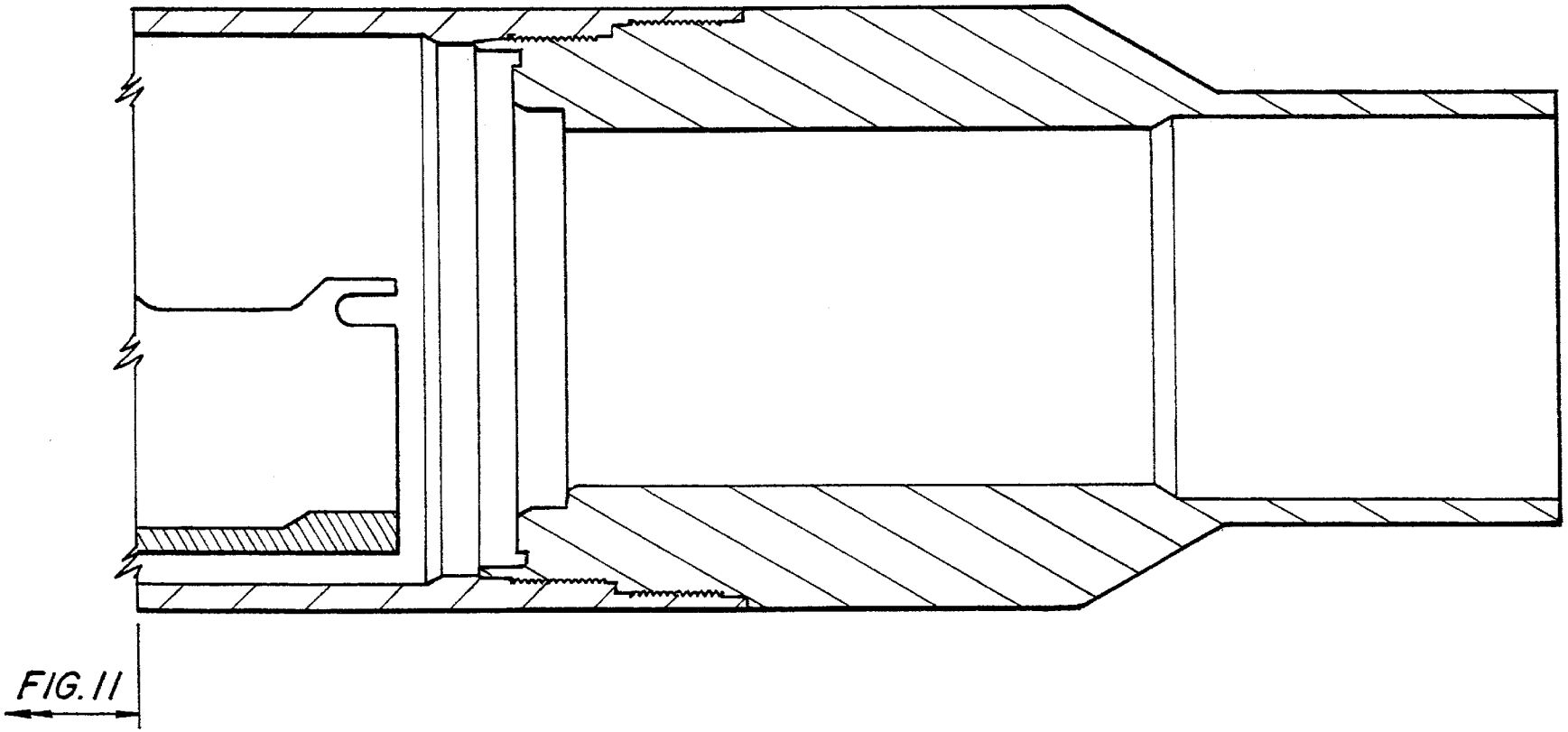

In an alternate embodiment of the invention, referring to FIGS. 7–12 the motor 46, pump 48 and sleeve 39 are replaced by a reciprocating positive displacement solenoid plunger pump 110. Referring specifically to FIG. 9, the solenoid pump 110 is illustrated in position within the tool as are all of the other components (which were not specifically excluded above) of the foregoing embodiment. These are in the same places and have the same function. This embodiment of the invention merely employs an alternative means for causing fluid pressure to rise in inlet 70. Changes exist in two components of the device in this embodiment: 1) the compensating piston is preferably constructed of a non-magnetic material to avoid a reduction of the field (employed in the operation of the solenoid) that occurs when a magnetic material is employed as the compensating piston. Inconel is a preferred choice for the substitute material of the compensating piston; and 2) the discharge connector 50' is distinct from discharge connector 50. This is due to the pump outlet and the function served by the connectors 50, 50'. In the motor/pump first embodiment, the discharge connector preferably is threaded into pump 48 and serves to physically hold the pump and the motor. In the second embodiment, the discharge connector 50' mounts as in a honed bore 112 and seals therein with o-ring 114 but is not fixedly attached. Rather, in a preferred arrangement for the second embodiment, discharge connector 50' is free to move in the bore 112 and the solenoid pump is fixed to the manifold 54 only by the T-bolts described above. In other respects the two embodiments are identical.

The solenoid pump embodiment employs a horseshoe wound solenoid to activate an integral plunger pump. More specifically, the armature of the solenoid is a pie shaped section of a ring. The section is approximately ¼ to ⅓ of the ring and includes sides of the pie section at about 45 degrees. The rest of the ring is wound to create the coils of the electromagnet in a direction parallel to the centerline of the ring. When the solenoid is energized, the gap of the pump closes compressing four springs and is the inlet stroke of the pump. When the coil is not energized, the springs extend to their normal length and the fluid that had been taken up in the inlet stroke of the pump is expelled under pressure. The solenoid pump is manufactured commercially by Sub Tech International (formally known as BEI Technology).

In a third embodiment of the invention, referring to FIGS. 16–19, a modified configuration of the invention is disclosed. For clarity, elements that are substantially similar will employ identical names as the foregoing and are distinguished therefrom by distinct numerals. Identical components retain the numerals as introduced hereinabove. It is also important to note that in FIGS. 16–19 the tool is shown in one position above the centerline and a second position below the centerline.

Figure 16:
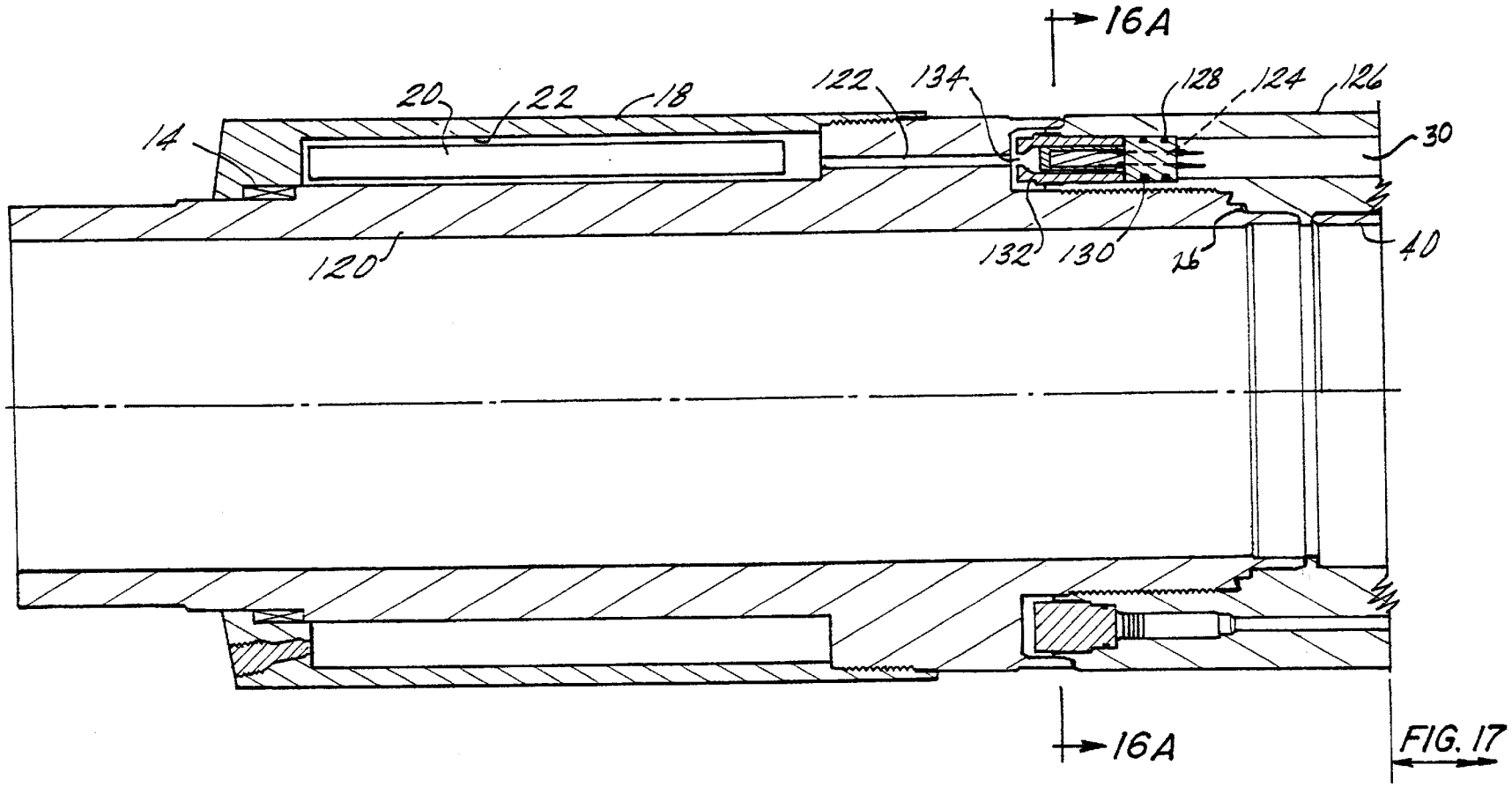
FIGS. 16–19 are an elongated view of another embodiment of the invention.

Beginning with FIG. 16 and proceeding seriatim, electronics housing 120 is connectable to an uphole string (not shown). Electronics housing 120 supports electronics package 30 within an annular space 22 which preferably is nitrogen filled. The space 22 is defined by an outer surface of housing 120 and by an inner surface of an electronics cover 20. Sealing of the preferred nitrogen gas is by a seal 14 at the uphole end of cover 20 and a premium thread 28 at the downhole end thereof. A distinguishing feature of this embodiment over the foregoing embodiment is that the premium thread 28 mates back up with the electronics housing 120 whereas in the foregoing embodiments it mated with intermediate sub 24. Electronics housing 120 further provides conductor conduit 122 which links annular space 22 and therefore electronics package 20 to high pressure connector 124 (preferably a Kemlon connector).

Figure 16A:
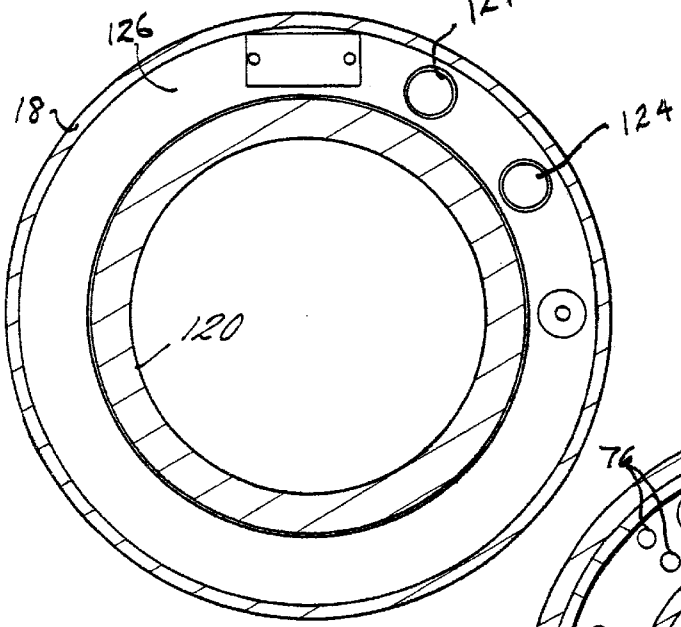
Figure 17:
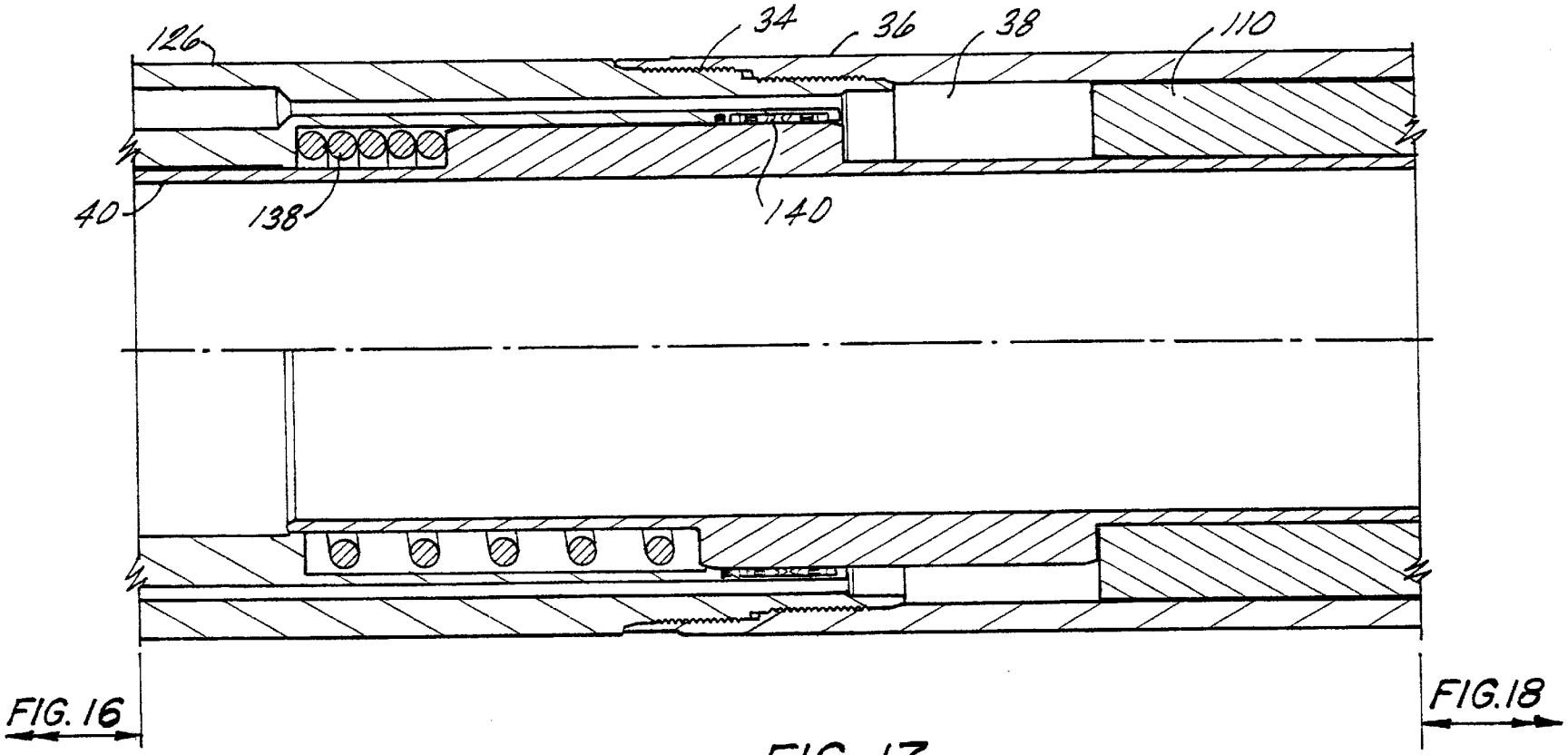

The connector 124 is inserted into an intermediate sub 126 and is sealed with preferably two O-rings 128 and 130. Connector 124 is retained in intermediate sub 126 by connector retainer 132 which is threadedly connected to intermediate sub 126. Connector retainer 132 further includes an axial bore 134 for passage of conductors (not shown). Preferably two connectors are employed. This can be ascertained by review of FIG. 16A.

Intermediate sub 126 provides a through bore 30 which provides passage for current carrying conductors (not shown) to the motor and pump and other electrical components. Housing 120 is connected to intermediate sub 126 at premium threaded connection 26 and threaded connection 136. On the downhole end of intermediate sub 126, it is threaded by connected and sealed to pump housing 36 at premium thread 34. Seal 140, preferably spring loaded Teflon seal is commercially available from Greene-Tweed & Company. Seal 140 rides against compensator piston 40 to seal hydraulic fluid chamber 38 while piston 40 works to pressure compensate the chamber 38 as in the foregoing embodiments. A back pressure spring 138 is preferred to assist in manufacture of the invention and keeps the piston urged against the hydraulic fluid in space 38 while the tool is at the surface.

Also within space 38, and bathed by the hydraulic fluid contained therein, is solenoid plunger pump 110 which is identical to that described in the second embodiment hereof. Moreover, the pump operates identically to the foregoing and pumps fluid to manifold 144 through union 142. Fluid pumped to manifold 144 is subsequently urged into the surface controlled subsurface safety valve components (not shown—conventional) to open the same in a manner known to the art.

Since it is desirable as described above that manifold 144 be bathed in hydraulic fluid, piston 40 is sealed downhole of manifold 144 by seal 146 and pump housing 36 is sealed by premium threaded connection 98. It will be appreciated from the drawing FIG. 18 that pump housing 36 is connected at 98 to RHN sub 148, which sub is employed in the invention in order to allow fluid to go from a single output to an annular fluid chamber created by RHN sub 148 and cylinder sub 152 to allow hydraulic fluid to go to one or more pistons which are located in cylinder sub 152. Seal 146 also terminates against RHN sub 148 which in a preferred embodiment includes wiper 150 to maintain piston 40 in a clean condition thus prolonging the life of seal 146. Finally, cylinder sub 152 (FIG. 19) is attached to RHN sub 148 by premium thread 154. Cylinder sub 152 functions to allow fluid from the output of the pump to access conventional rod piston(s) (which actuate the SCSSV) connected as its downhole end to an otherwise conventional SCSSV. It will be appreciated that the high pressure hydraulic fluid conduit 156 continues from manifold 144 to the SCSSV (not shown) to supply high pressure hydraulic fluid thereto.

Figure 18B:
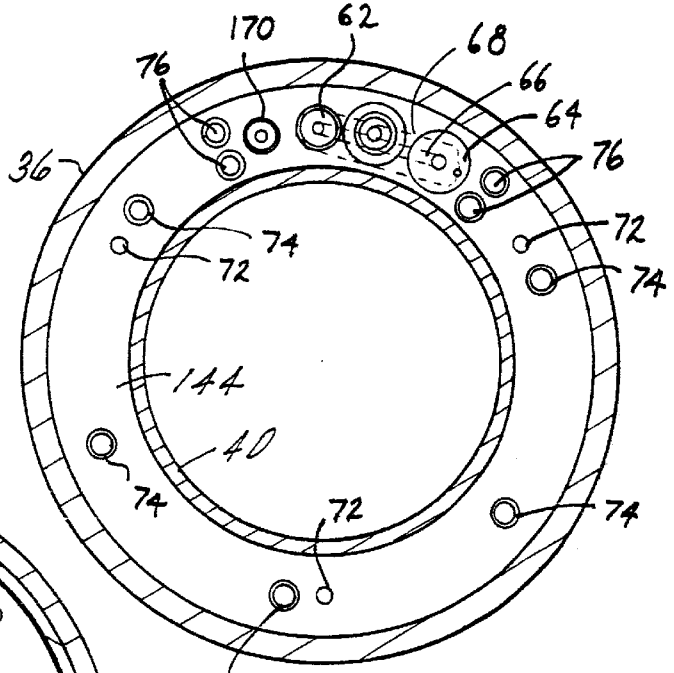
FIGS. 16A, 18A and 18B are cross section views of the embodiment of FIGS. 16–18 taken at cross section lines as illustrated.
Figure 18A:
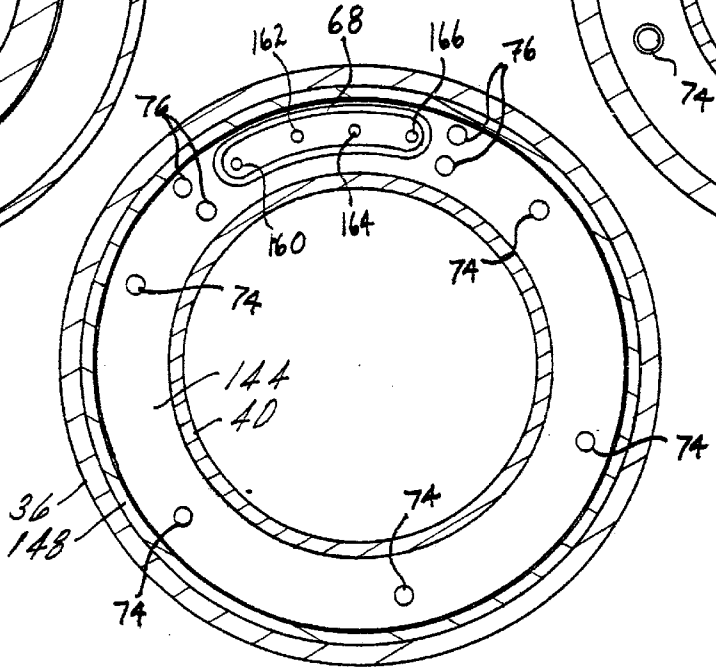
Figure 18:
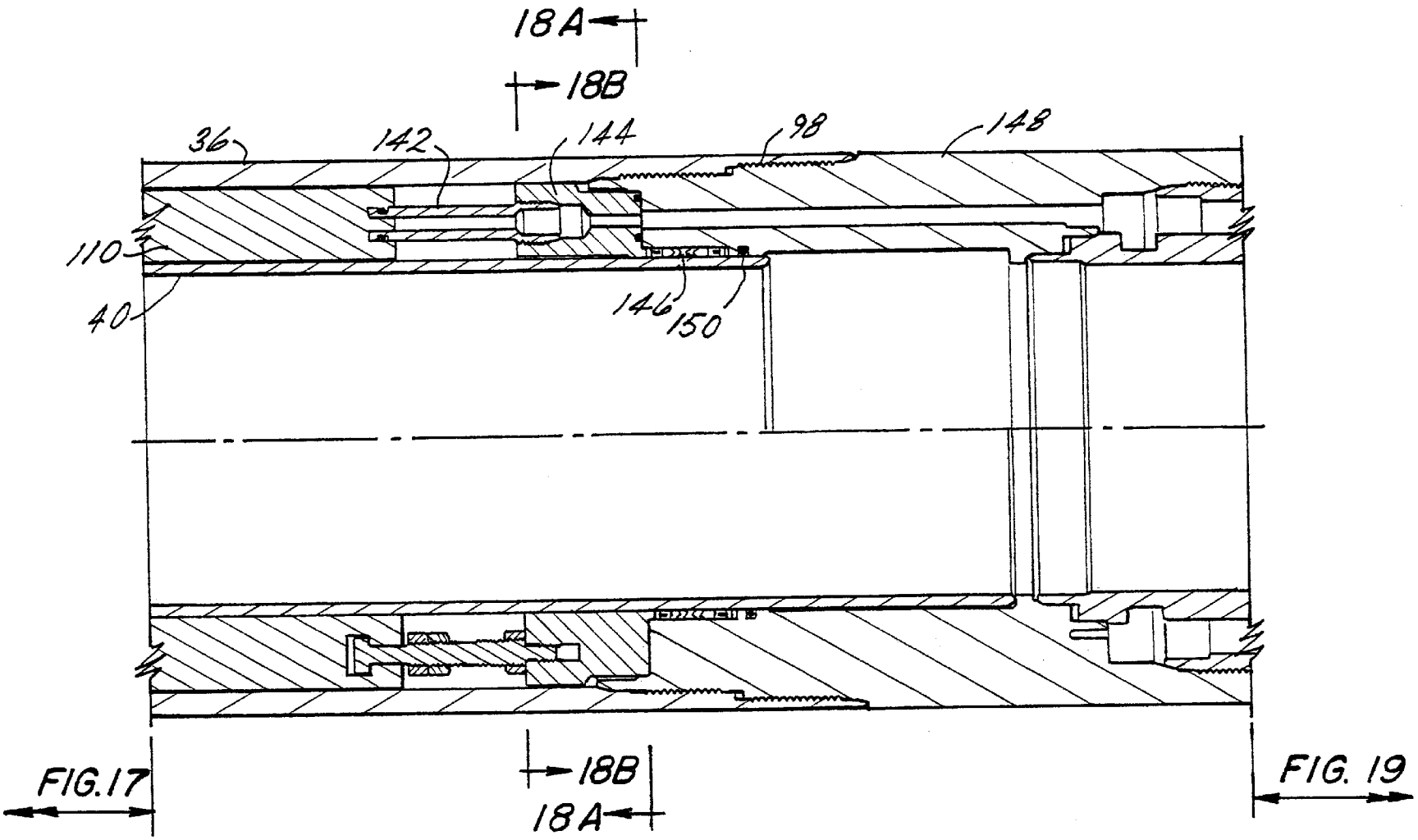
Figure 19:
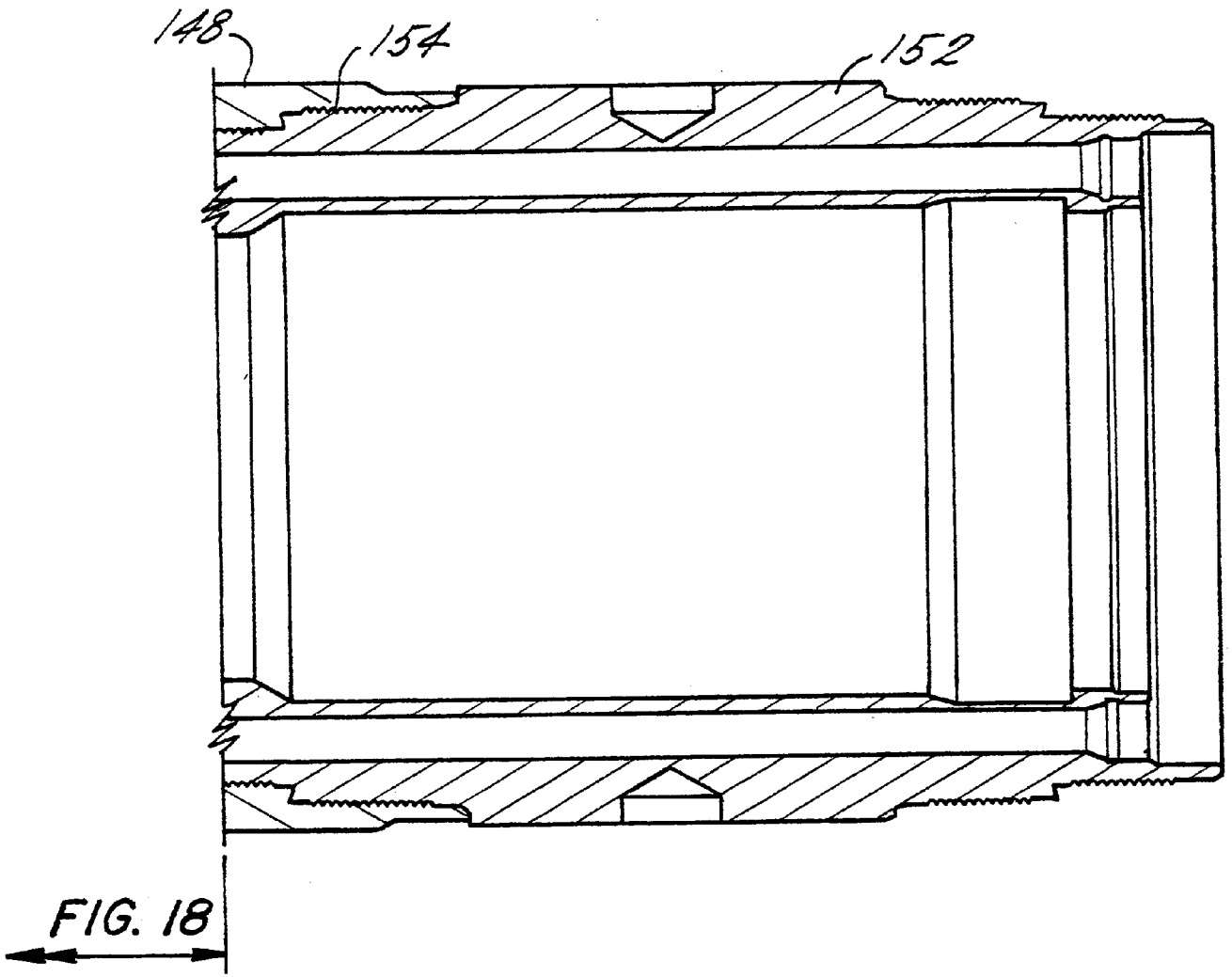

Turning now to FIGS. 18A and 18B, the manifold 144 of this embodiment of the invention is illustrated in cross-section as indicated by cross-section lines 18A—18A and 18B—18B in FIG. 18. Manifold 144 is similar to the foregoing embodiments but in this embodiment is configured to accept electronics designed to provide additional information while maintaining the desired function of the manifold as described hereinabove.

Referring directly to FIG. 18A, one will recognize from the foregoing description holes 74 and 76 as well as O-ring groove 68. New to the view is openings 160, 162, 164 and 166. These are positioned to optimize function of the manifold and provide fluid continuity to various structures mounted on the uphole side of manifold 144. Referring then to FIG. 18B, the uphole side of manifold 144 is illustrated. As one will appreciate, holes 72, 74 and 76 are illustrated as have been described hereinbefore. Also illustrated are a piloting solenoid port 64 which is in fluid connection with opening 160 to supply high pressure hydraulic fluid to the SCSSV. Adjacent the solenoid valve port 64 is a port 168 for a transducer such as a BEI EDCLIFF transducer which is commercially available from BEI EDCLIFF. The transducer provides information regarding the pressure of the fluid in the control line which holds open the flapper valve of the conventional SCSSV. Such information is valuable to determine the degree of openness of the flapper. Union port 62 is as in the previous embodiments, and a port 170 for a second transducer having one or more capabilities e.g. differential pressure measurement, pressure measurement, etc. which preferably monitors tubing pressure. The preferred transducer is such as a Sensotec transducer which is commercially available from Sensotec. Port 170 communicates with opening 166 port 62 with opening 164 and port 168 communicates with opening 162.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An actuation system for a downhole tool comprising:

a downhole actuation fluid reservoir;

a fluid pump in communication with said reservoir and in communication with said tool;

a motor connected to said fluid pump;

a draw sensor connected to said motor for automatic shut-off of said motor; and a dump valve having access to pressurized fluid moving between said pump and said tool.

2. An actuation system for a downhole tool as claimed in claim 1 wherein said system further includes a downhole controller to control operation of said pump and said dump valve.

3. An actuation system for a downhole tool as claimed in claim 1 wherein said reservoir is defined by an outer housing and an inner pressure compensating piston.

4. An actuation system for a downhole tool as claimed in claim 1 wherein said system further includes a sensor to detect pressure.

5. An actuation system for a downhole tool as claimed in claim 4 wherein said pressure is differential pressure between different pressure environments.

6. An actuation system for a downhole tool as claimed in claim 4 wherein said pressure is absolute pressure of the downhole environment.

7. An actuation system for a downhole tool comprising:

a downhole actuation fluid reservoir;

a solenoid operating positive displacement plunger pump in communication with said reservoir and in communication with said tool; and a dump valve having access to pressurized fluid moving between said pump and said tool.

8. An actuation system for a downhole tool comprising:

a downhole actuation fluid reservoir;

a fluid pump in communication with said reservoir and in communication with said tool; and a normally open solenoid operating piloting valve having access to pressurized fluid moving between said pump and said tool.

9. An actuation system for a downhole tool comprising:

a downhole actuation fluid reservoir;

a fluid pump in communication with said reservoir and in communication with said tool;

a dump valve having access to pressurized fluid moving between said pump and said tool;

a downhole controller to control operation of said pump and said dump valve wherein said controller powers said dump valve to close said dump valve and powers said motor to pump fluid from said reservoir to said downhole tool.

10. An actuation system for a downhole tool comprising:

a downhole actuation fluid reservoir;

a fluid pump in communication with said reservoir and in communication with said tool; and a dump valve having access to pressurized fluid moving between said pump and said tool said dump valve being mounted in a manifold that provides access to said pressurized fluid.

11. An actuation system for a downhole tool as claimed in claim 10 wherein said manifold is mounted and maintained within said reservoir and is protected from wellbore fluids thereby.

12. An actuation system for a surface controlled subsurface safety valve comprising:

a housing attachable to a subsurface safety valve, said housing containing:

a hydraulic fluid reservoir;

a fluid pressurizer in fluid communication with said reservoir;

a manifold providing a fluid conduit between said fluid pressurizer and said safety valve and a fluid channel intersecting said fluid conduit;

a dump valve connected to said fluid channel in said manifold;

an electronics package mounted within said housing and electronically connected to said fluid pressurizer and said dump valve.

13. An actuation system for a surface controlled subsurface safety valve as claimed in claim 12 wherein said hydraulic fluid reservoir further includes a pressure compensator piston.

14. An actuation system for a surface controlled subsurface safety valve as claimed in claim 12 wherein said dump valve exhausts to said reservoir.

15. An actuation system for a surface controlled subsurface safety valve as claimed in claim 12 wherein said fluid pressurizer is a motor and pump combination.

16. An actuation system for a surface controlled subsurface safety valve as claimed in claim 12 wherein said fluid pressurizer is a solenoid plunger pump.

17. An actuation system for a surface controlled subsurface safety valve as claimed in claim 16 wherein said pump is a reciprocating positive displacement pump.

18. An actuation system for a surface controlled subsurface safety valve as claimed in claim 12 wherein said dump valve is a normally open solenoid operating piloting valve.

19. An actuation system for a surface controlled subsurface safety valve as claimed in claim 12 wherein said housing contains a pressure sensor.

20. An actuation system for a surface controlled subsurface safety valve as claimed in claim 19 wherein said pressure sensor is for differential pressure.

21. An actuation system for a surface controlled subsurface safety valve as claimed in claim 19 wherein said pressure sensor is for absolute pressure.

* * * * *